US006695595B2

(12) United States Patent
Wu

(10) Patent No.: US 6,695,595 B2
(45) Date of Patent: Feb. 24, 2004

(54) PUMP FOR PUMPING AT TWO PRESSURES

(76) Inventor: Scott Wu, No. 6, Lane 176, Wu Fu Road, Wu Feng Hsiang, Taichung Hsien (TW)

( * ) Notice: Subject to any disclaimer, the term of this patent is extended or adjusted under 35 U.S.C. 154(b) by 15 days.

(21) Appl. No.: 10/222,052

(22) Filed: Aug. 16, 2002

(65) Prior Publication Data

US 2003/0002989 A1 Jan. 2, 2003

(51) Int. Cl.[7] ..... F04B 1/00; F04B 23/00; F04B 39/10

(52) U.S. Cl. ..... 417/530; 417/440; 417/442; 417/468; 417/506; 417/562; 417/520

(58) Field of Search ..... 417/530, 440, 417/442, 468, 506, 562, 520

(56) References Cited

U.S. PATENT DOCUMENTS 1,484,549 A * 2/1924 Burnam ..... 417/528
5,299,917 A * 4/1994 Schultz ..... 417/238
5,759,018 A * 6/1998 Thanscheidt ..... 417/531
6,257,849 B1 * 7/2001 Wu ..... 417/469
6,371,741 B1 * 4/2002 Wu ..... 417/446
6,428,290 B1 * 8/2002 Wang ..... 417/468

* cited by examiner

*Primary Examiner*—Justine R. Yu
*Assistant Examiner*—Michael K. Gray
(74) *Attorney, Agent, or Firm*—Alan Kamrath; Rider Bennett, LLP

(57) ABSTRACT

A pump includes a cylinder, a piston assembly, a first nozzle, a valve, a controller, a ring and a second nozzle. The cylinder defines first and second chambers and first and second channels for communication between the chambers. The piston assembly is received in the first chamber. The first nozzle defines a channel. The valve is received in the first chamber. The controller defines an axial channel and a radial channel communicated with the axial channel, and is received in the second chamber and linked to the valve through the second channel. The controller is movable between a first position for allowing the valve to seal the second channel and a second position for driving the valve to open the second channel. The ring is mounted on the controller so as to divide the second chamber into a first portion for communication between the first channel and the channel of the first nozzle and a second portion for communication between the second channel and the radial channel of the controller. The second nozzle defines an axial channel communicated with the axial channel of the controller.

14 Claims, 5 Drawing Sheets

PUMP FOR PUMPING AT TWO PRESSURES

BACKGROUND OF INVENTION

1. Field of Invention

The present invention relates to a pump for bicycles and, more particularly, to a pump for pumping at two pressures.

2. Related Prior Art

Cycling is a popular activity for exercising. Many people ride mountain bikes equipped with pneumatic cushions. A great proportion of such riders carry pumps on their mountain bikes for pumping tires and pneumatic pumps. A pneumatic cushion however requires less air at a higher pressure than a tire does. A nozzle designed for engagement with an inlet of a tire often fails engagement with an inlet of a pneumatic cushion for being unable to sustain such a high pressure during pumping of the pneumatic cushion. To avoid this problem, a pump may be equipped with an ordinary nozzle for engagement with an inlet of a tire and a high-pressure nozzle for engagement with an inlet of a pneumatic cushion. However, such a high-pressure nozzle is often forgotten or lost, thus rendering it impossible to pump such a pneumatic cushion. Besides, it is always troublesome to replace an ordinary nozzle with a high-pressure nozzle and vice versa. Moreover, engagement of an ordinary or high-pressure nozzle with a flexible pipe leading from such a pump becomes slack after replacement takes place for some times.

The present invention is intended to obviate or at least alleviate the problems encountered in prior art.

SUMMARY OF INVENTION

It is the primary objective of the present invention to provide a pump for pumping at two different pressures.

According to the present invention, a pump includes a cylinder, a piston assembly, a first nozzle, a valve, a controller, a ring and a second nozzle. The cylinder defines first and second chambers and first and second channels for communication between the chambers. The piston assembly is received in the first chamber. The first nozzle defines a channel. The valve is received in the first chamber. The controller defines an axial channel and a radial channel communicated with the axial channel, and is received in the second chamber and linked to the valve through the second channel. The controller is movable between a first position for allowing the valve to seal the second channel and a second position for driving the valve to open the second channel. The ring is mounted on the controller so as to divide the second chamber into a first portion for communication between the first channel and the channel of the first nozzle and a second portion for communication between the second channel and the radial channel of the controller. The second nozzle defines an axial channel communicated with the axial channel of the controller.

Other objects, advantages, and novel features of the invention will become apparent from the following detailed description when taken in conjunction with the attached drawings.

BRIEF DESCRIPTION OF DRAWINGS

The present invention will be described through detailed illustration of embodiments referring to the attached drawings wherein.

DETAILED DESCRIPTION OF PREFERRED EMBODIMENT

Figure 1:
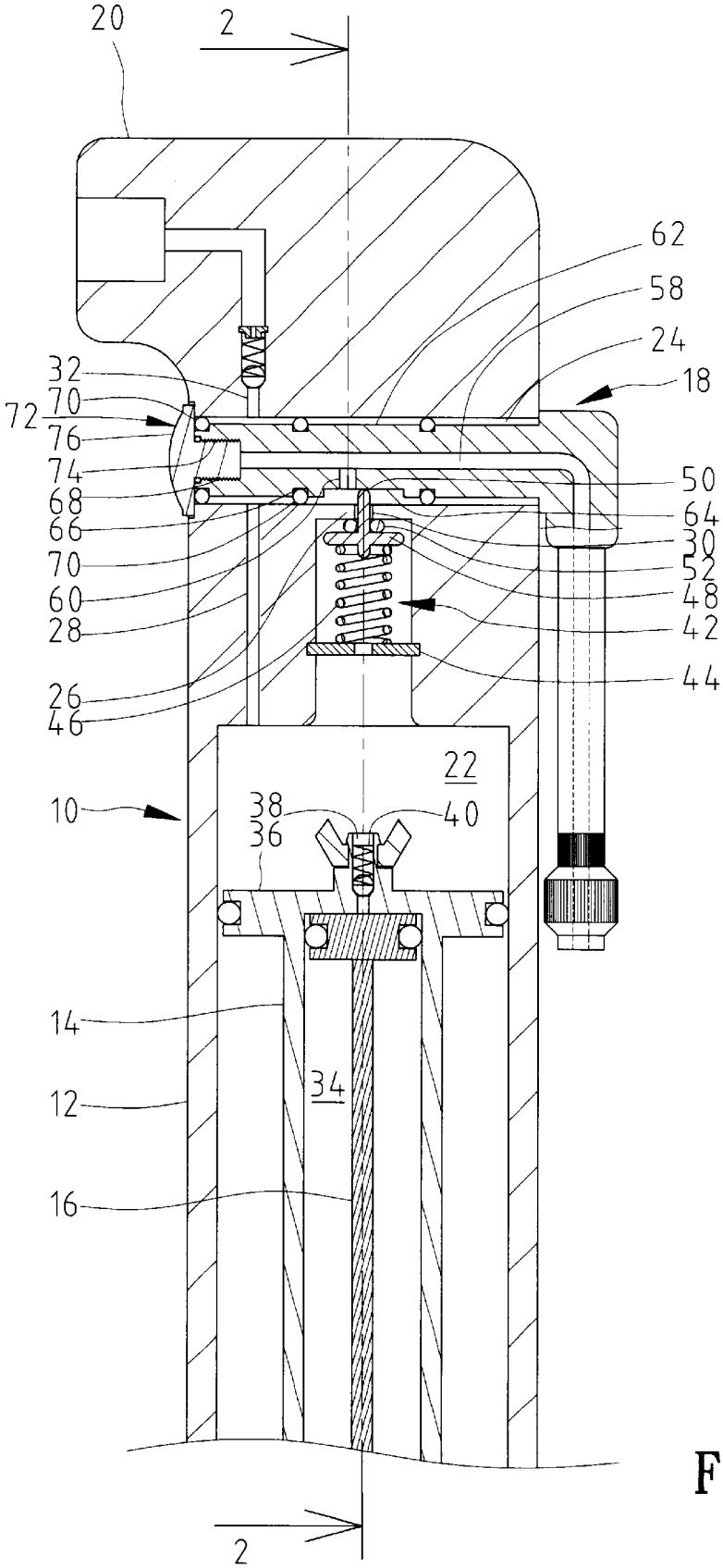
FIG. 1 is a cross-sectional partial view of a pump according to the present invention.
Figure 2:
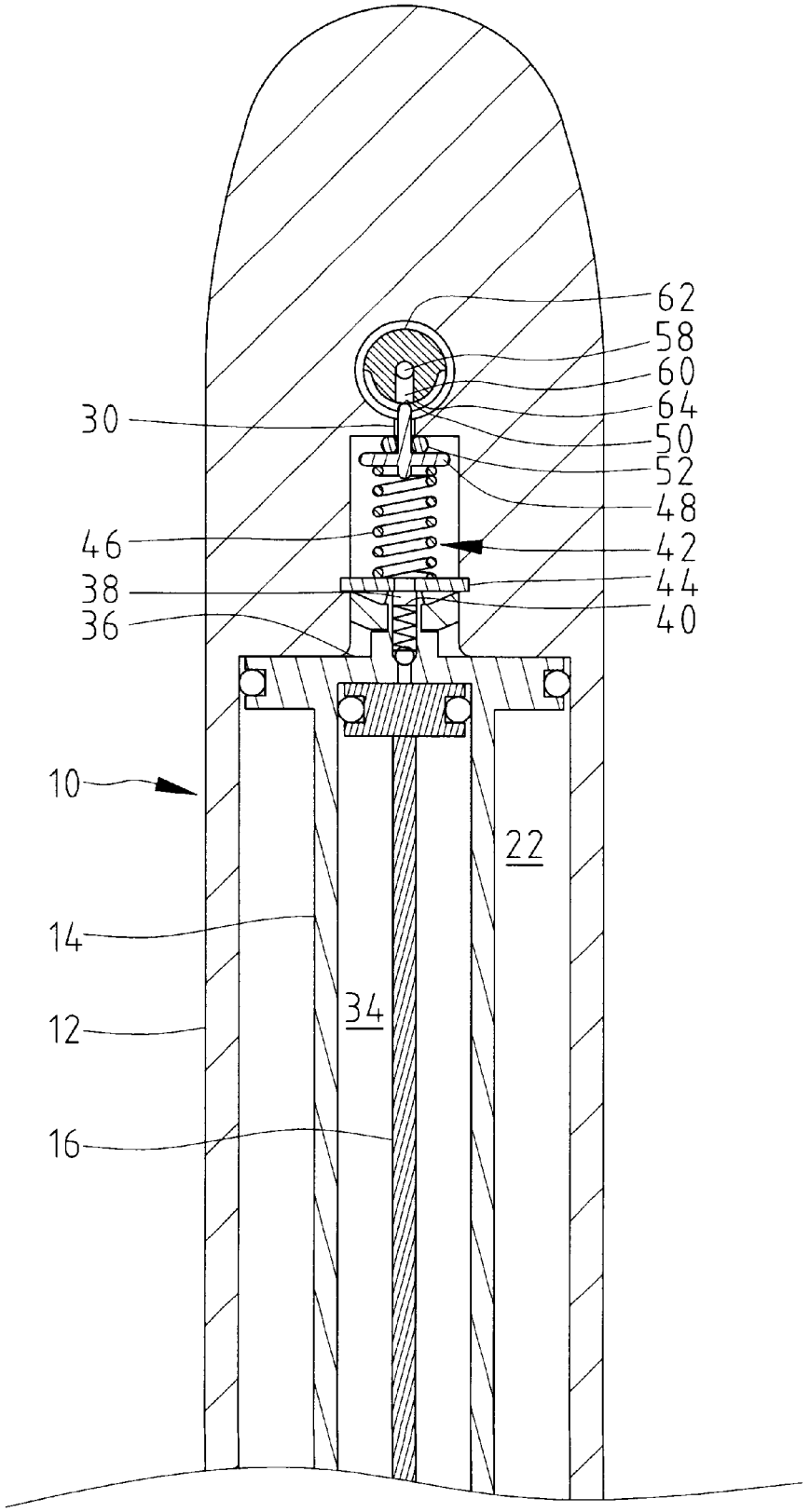
FIG. 2 is a cross-sectional partial view taken along a line 2—2 in FIG. 1.
Figure 3:
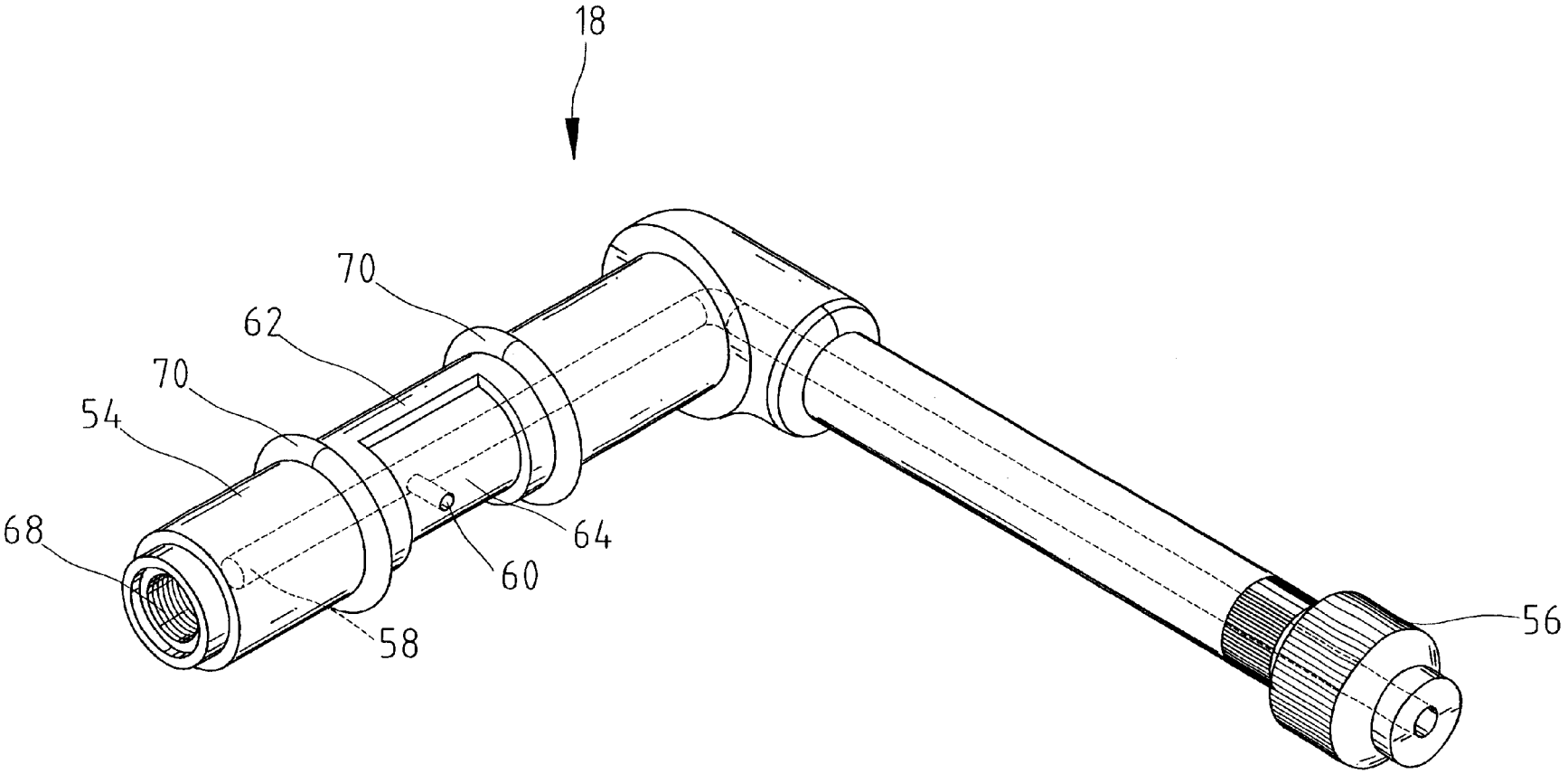
FIG. 3 is a perspective view of a controller/nozzle used in a pump according to the present invention.

Referring to FIGS. 1~3, according to the preferred embodiment of the present invention, a pump 10 includes a cylinder 12, a piston/cylinder 14 reciprocally received in the cylinder 12, a piston 16 reciprocally received in the piston/cylinder 14 and a controller/nozzle 18 rotationally received in the cylinder 12.

The cylinder 10 includes an end at which a nozzle 20 is formed. The cylinder 10 defines a first chamber 22 with a reduced portion, a second chamber 24 separated from the reduced portion of the first chamber 22 via a partition 26, a first channel 28 through which the first chamber 22 is communicated with the second chamber 24, a second channel 30 extending through the partition 26 so that the reduced portion of the first chamber 22 is communicated with the second chamber 24 through the second channel 30. The nozzle 20 defines a channel 32 communicated with the second chamber 24 of the cylinder 12.

The piston/cylinder 14 is hollow, i.e., defines a chamber 34. The piston/cylinder 14 includes an enlarged end 36 defining a channel 38 communicated with the chamber 34. A check valve 40 is installed in the channel 38. The piston/cylinder 14 can be used as a piston reciprocated in the first chamber 22 of the cylinder 12 for pumping.

Like the piston/cylinder 14, the piston 16 includes an enlarged end. The piston 16 is received in the chamber 34 of the piston/cylinder 14. For pumping, the first pressure the piston 16 can be reciprocated in the chamber 34 of the piston/cylinder 14 that is now used as a cylinder instead of a piston.

A valve 42 is installed in the reduced portion of the first chamber 22 of the cylinder 12 for closing and opening the second channel 30 of the cylinder 12. The valve 42 consists of a stop 44, a spring 46, a shutter 48 and a seal 52. The stop 44 defines a central aperture and includes an external edge received in an annular groove defined in a wall of the reduced portion of the first chamber 22 of the cylinder 12. The spring 46 is received in the reduced portion of the first chamber 22 of the cylinder 12 so as to contact the annular stop 44. The shutter 48 includes a first side and a second side from which a rod 50 extends. A seal 52 in the form of a ring is mounted on the rod 50. The shutter 48 is received in the reduced portion of the first chamber 22 of the cylinder 12 so that its first side contacts the spring 46, and that the rod 50 extends through the second channel 30 of the cylinder 12, and that the seal 52 can contact the partition 26 in order to seal the second channel 30 of the cylinder 12.

As best shown in FIG. 3, the controller/nozzle 18 includes a controller 54 and a nozzle 56 extending from the controller 54. An axial channel 58 extends through the entire controller/nozzle 18. A radial channel 60 extends in the controller 54 so as to be communicated with the axial channel 58. The controller 54 includes an external face that includes an ordinary portion 62 of an ordinary radius and a reduced portion 64 of a reduced radius. The radial channel 60 extends through the reduced portion 64. As best shown in FIG. 1, two annular grooves 66 are defined in the external face of the controller 54. The reduced portion 64 is located between the annular grooves 66. The controller 54 includes a free end of a reduced diameter and a thread 68 formed on an internal face at the free end.

An annular seal or ring 70 is received in each of the grooves 66. An annular seal 70 is mounted on the free end of the controller 54. The controller 54, together with the annular seals 70, is inserted in the second chamber 24 of the cylinder 12. Thus, the second chamber 24 of the cylinder 12 is divided into a first portion through which the first channel 28 is communicated with the channel 32 of the nozzle 20 and a second portion through which the second channel 30 is communicated with the channel 32 of the nozzle 20 defined between the wall of the second chamber 24 of the cylinder 12 and the external face of the controller 54 and between the annular seals 70. A bolt 72 includes a thread 74 formed thereon for engagement with the thread 68 of the controller 54 and a head 76 for retaining the controller 54 on the cylinder 12.

Figure 4:
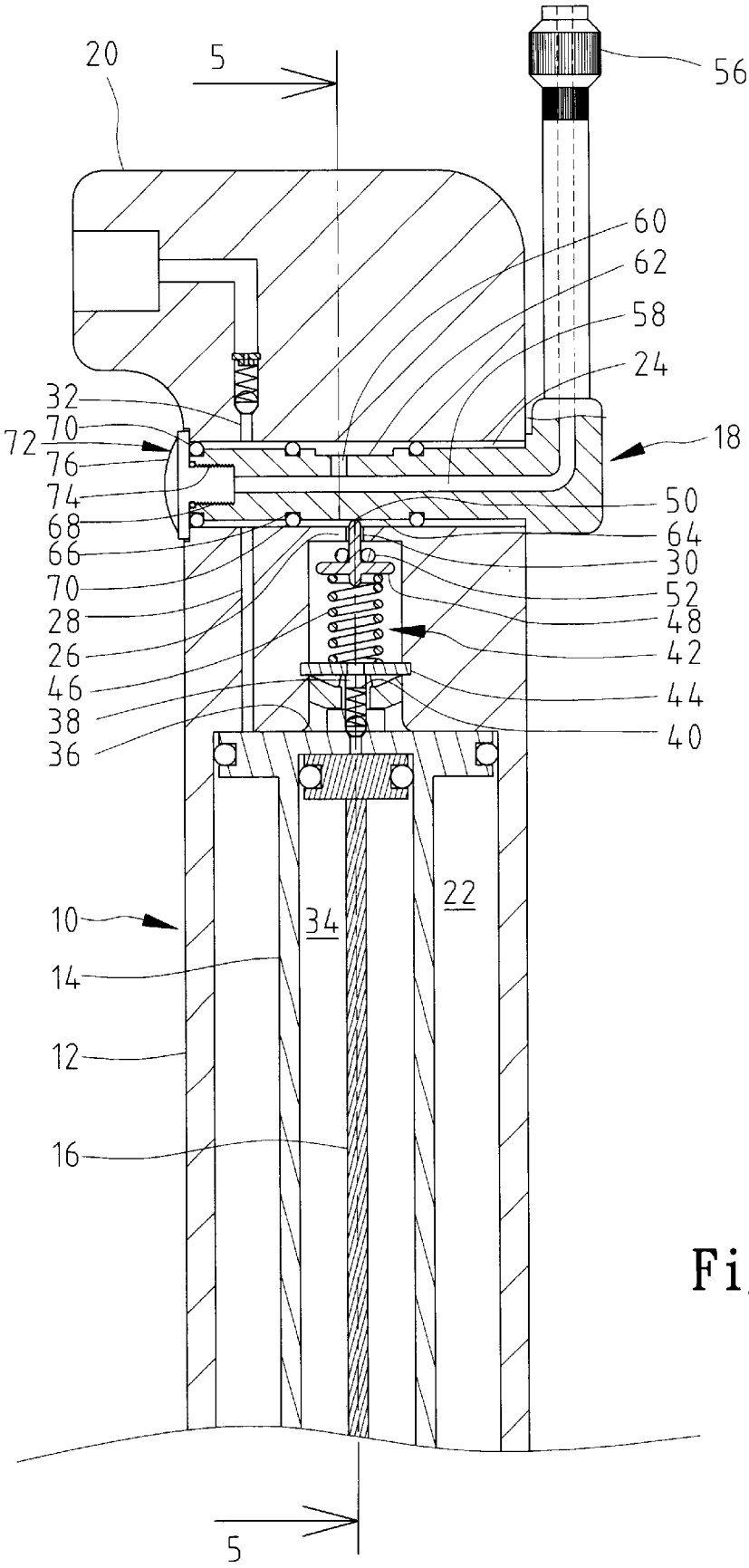
FIG. 4 is similar to FIG. 1 but showing the pump in a second position.
Figure 5:
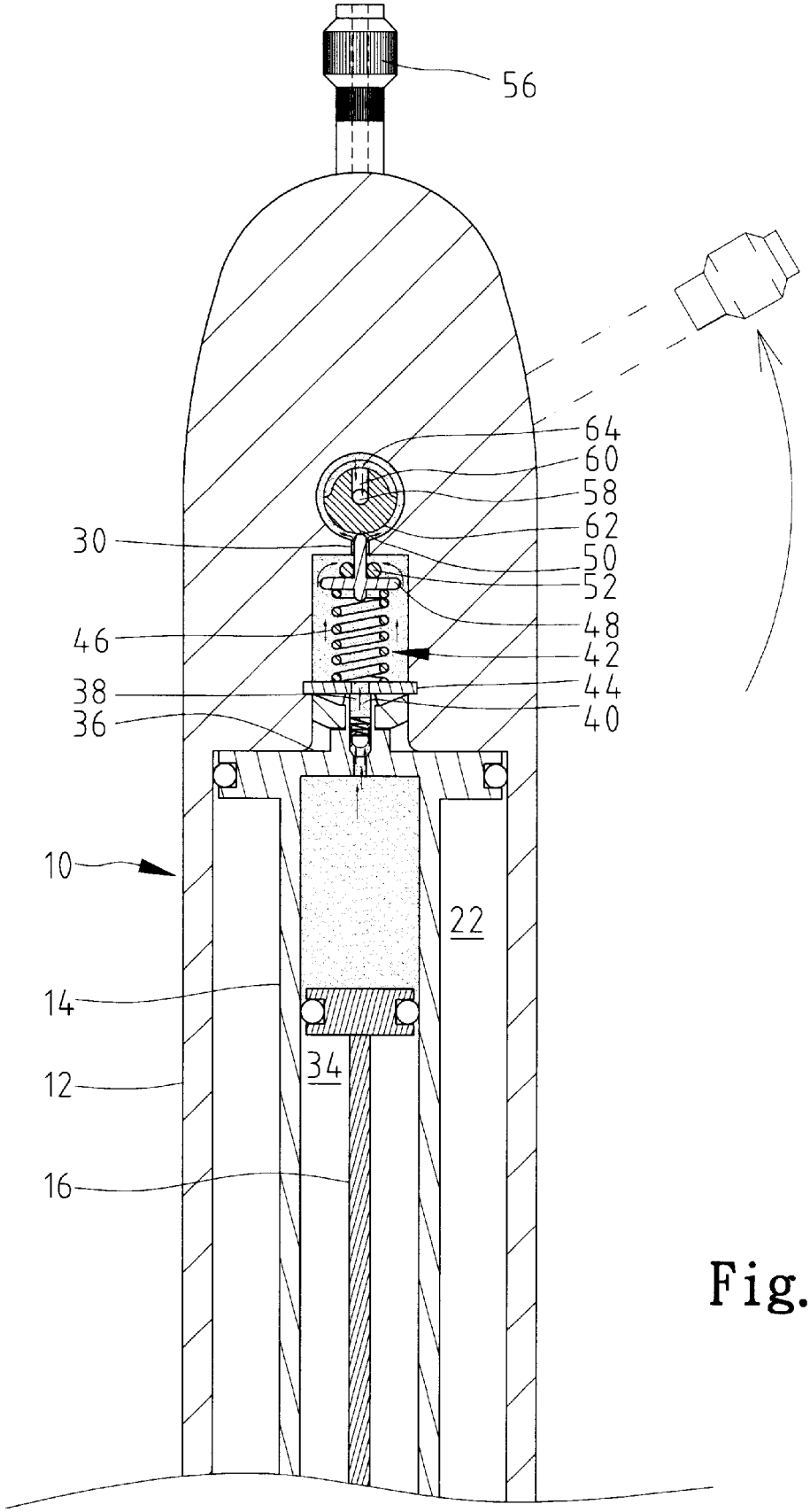
FIG. 5 is a cross-sectional partial view taken along a line 5—5 in FIG. 4.

The controller 54 can be rotated in the second chamber 24 of the cylinder 12 between a first position shown in FIGS. 1 and 2 in order to pump at a first pressure and a second position shown in FIGS. 4 and 5 in order to pump at a second pressure higher than the first pressure.

To pump at the first pressure, the controller 54 is located in the first position where the reduced portion 64 of the controller 54 is in contact with or at a very limited distance from the rod 50. Thus, the seal 48 is allowed to contact the partition 26 in order to seal the second channel 30 of the cylinder 12. Air can only be transmitted from the first chamber 22 through the first channel 28 of the cylinder 12 to the channel 32 of the nozzle 20 through the first channel 28 of the cylinder 12 and the first portion of the second chamber 24 of the cylinder 12. The enlarged end of the piston 16 is positioned against the enlarged end 36 of the piston/cylinder 14. Due to this position of the piston 16 relative to the piston/cylinder 14 and due to the check valve 40, air cannot be driven into the chamber 34 of the piston/cylinder 14. The piston/cylinder 14 can be reciprocated in the first chamber 22 of the cylinder 12 in order to drive air out of the nozzle 20 at the first pressure.

To pump at the second pressure, the controller 54 is located in the second position where the ordinary portion 62 of the controller 54 pushes the rod 50 so as to disengage the seal 48 from the partition 26, thus opening the second channel 30 of the cylinder 12. Air can be driven from the first chamber 22 of the cylinder 12 to the channels 58 and 60 of the controller/nozzle 18 through the second channel 30 of the cylinder 12 and the second portion of the second chamber 24 of the cylinder 12. In addition, the enlarged end 36 of the piston/cylinder 14 is moved to an end of its stroke in the first chamber 22 of the cylinder 12 so as to seal the first channel 28 of the cylinder 12. The piston 16 is reciprocated in the chamber 34 of the piston/cylinder 14 in order to drive air out of the nozzle 56 at the second pressure.

The present invention has been described through detailed illustration of the preferred embodiment. Those skilled in the art can derive many variations from the preferred embodiment without departing from the scope of the present invention. Therefore, the preferred embodiment shall not limit the scope of the present invention. The scope of the present invention is defined in the attached claims.

What is claimed is:

1. A pump including:

a cylinder defining first and second chambers and first and second channels for communication between the chambers;

a piston assembly received in the first chamber;

a first nozzle defining a channel;

a valve received in the first chamber;

a controller defining an axial channel and a radial channel communicated with the axial channel and being received in the second chamber and linked to the valve through the second channel, wherein the controller is movable between a first position for allowing the valve to seal the second channel and a second position for driving the valve to open the second channel;

a ring mounted on the controller so as to divide the second chamber into a first portion for communication between the first channel and the channel of the first nozzle and a second portion for communication between the second channel and the radial channel of the controller; and a second nozzle defining an axial channel communicated with the axial channel of the controller.

2. The pump according to claim 1 wherein the valve includes a rod extending into the second chamber through the second channel.

3. The pump according to claim 2 wherein the controller includes an external face including a normal portion contacting the rod in the second position and a reduced portion facing the rod in the second position.

4. The pump according to claim 3 wherein the controller is rotated between the first and second positions.

5. The pump according to claim 4 wherein the valve includes a seal mounted on the rod for sealing the second channel.

6. The pump according to claim 1 wherein the valve includes a spring for biasing the rod towards the controller.

7. The pump according to claim 6 wherein the valve includes a stop secured to a wall of the first chamber in order to support the spring.

8. The pump according to claim 1 wherein the piston assembly includes:

a piston/cylinder defining a chamber and including an end defining a channel communicated with the chamber thereof, wherein the piston/cylinder can be reciprocated in the first chamber for pumping at a first pressure; and a piston received in the chamber of the piston/cylinder for pumping at a second pressure higher than the first pressure.

9. The pump according to claim 8 including a check valve (40) received in the channel.

10. A pump including:

a cylinder defining first and second chambers and first and second channels for communication between the chambers;

a piston assembly received in the first chamber;

a first nozzle defining a channel;

a valve received in the first chamber and formed with a rod;

a controller defining an axial channel and a radial channel communicated with the axial channel thereof and including a normal portion and a reduced portion, wherein the controller is movable between a first position where the reduced portion allows the rod to extend into the second chamber so that the valve seals the second channel and a second position where the normal portion pushes the rod from the second chamber so that the valve opens the second channel;

a ring mounted on the controller so as to divide the second chamber into a first portion for communication between the first channel of the cylinder and the channel of the first nozzle and a second portion for communication between the second channel of the cylinder and the radial channel of the controller; and a second nozzle defining a channel communicated with the axial channel of the controller.

11. The pump according to claim 10 wherein the controller is rotated between the first and second positions.

12. The pump according to claim 10 wherein the valve includes a seal mounted on the rod for sealing the second channel.

13. The pump according to claim 10 wherein the valve includes a spring for biasing the valve toward the controller.

14. The pump according to claim 13 wherein the valve includes a stop secured to a wall of the first chamber in order to support the spring.

* * * * *